US011091900B2

(12) United States Patent
Moriki et al.

(10) Patent No.: US 11,091,900 B2
(45) Date of Patent: Aug. 17, 2021

(54) CONSTRUCTION MACHINE

(71) Applicant: HITACHI CONSTRUCTION MACHINERY CO., LTD., Tokyo (JP)

(72) Inventors: Hidekazu Moriki, Tokyo (JP); Hiroshi Sakamoto, Tsuchiura (JP); Manabu Edamura, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 281 days.

(21) Appl. No.: 16/339,074

(22) PCT Filed: Oct. 25, 2017

(86) PCT No.: PCT/JP2017/038570
§ 371 (c)(1),
(2) Date: Apr. 3, 2019

(87) PCT Pub. No.: WO2018/092533
PCT Pub. Date: May 24, 2018

(65) Prior Publication Data

US 2019/0284783 A1 Sep. 19, 2019

(30) Foreign Application Priority Data

Nov. 21, 2016 (JP) ..... JP2016-226255

(51) Int. Cl.
*E02F 9/26* (2006.01)
*E02F 3/32* (2006.01)
*E02F 3/43* (2006.01)

(52) U.S. Cl.
CPC ..... *E02F 9/264* (2013.01); *E02F 3/32* (2013.01); *E02F 3/43* (2013.01); *E02F 9/261* (2013.01); *E02F 3/435* (2013.01)

(58) Field of Classification Search
CPC ..... E02F 3/32; E02F 3/43; E02F 3/435; E02F 9/261; E02F 9/264
See application file for complete search history.

(56) References Cited

U.S. PATENT DOCUMENTS 6,374,147 B1 * 4/2002 Rockwood ..... B66F 9/0655 414/699
6,934,616 B2 8/2005 Colburn et al.
(Continued)

FOREIGN PATENT DOCUMENTS

CN 105518220 A 4/2016

OTHER PUBLICATIONS

Chinese Office Action received in corresponding Chinese Application No. 201780052651.7 dated Aug. 19, 2020.
(Continued)

*Primary Examiner* — Tyler J Lee
(74) *Attorney, Agent, or Firm* — Mattingly & Malur, PC

(57) ABSTRACT

The construction machine includes: a body (9, 10); work equipment (15) having a plurality of swingable work elements (8, 11, 12); a plurality of hydraulic actuators (5, 6, 7) for driving the work equipment; a plurality of ground angle sensors (13*a* to 13*d*) for detecting the ground angles of the work elements; and an excavation support device (400) including an information processing device (100). The information processing device includes: a load information acquiring section (130) for acquiring load information including the load direction in the swing center of at least one of the work elements according to signals from the ground angle sensors; and a working point position calculating section (150) for calculating the position of the working point of the work equipment according to the signals from the ground angle sensors and the load information from the load information acquiring section.

6 Claims, 10 Drawing Sheets

(56) References Cited

U.S. PATENT DOCUMENTS

| | | | | |
|---|---|---|---|---|
| 7,007,415 | B2 * | 3/2006 | Koch | E02F 3/437 37/348 |
| 7,631,445 | B2 * | 12/2009 | Harrell | E02F 3/435 37/309 |
| 7,669,354 | B2 * | 3/2010 | Aebischer | E02F 9/264 37/348 |
| 9,752,298 | B2 * | 9/2017 | Nakamura | E02F 9/2029 |
| 10,422,111 | B2 * | 9/2019 | Yamada | E02F 9/265 |
| 2004/0117095 | A1 | 6/2004 | Colburn et al. | |
| 2017/0284069 | A1 * | 10/2017 | Machida | H04N 5/225 |
| 2017/0298595 | A1 * | 10/2017 | Machida | E02F 9/261 |

OTHER PUBLICATIONS

International Search Report of PCT/JP2017/038570 dated Jan. 30, 2018.

* cited by examiner

CONSTRUCTION MACHINE

TECHNICAL FIELD

The present invention relates to construction machines and more particularly to a technical field which supports an operator's operation in excavation work.

BACKGROUND ART

Excavation support devices which support manipulation of an operator's operation in excavation work when making a three-dimensional target shape from an original landform by a construction machine are known. Examples are a machine guidance which displays the positional relation between the target shape and the work equipment (for example, a bucket or the like) on a monitor instead of the finishing stake used in the conventional construction work, a machine control which semi-automatically controls the construction machine according to the deviation between the target shape and the position of the work equipment, and the like.

These excavation support devices calculate the position of the working point of the work equipment according to the work equipment's posture acquired by a posture sensor on the basis of the dimensions of the work equipment. For example, as shown in FIG. 1, taking the boom foot pin position as origin 0, and the forward and upward directions with respect to the body as an x axis and a z-axis respectively, the position ($W_x$, $W_x$) of the bucket claw W as the working point is calculated according to the angles $\theta_{BM}$, $\theta_{AM}$ and $\theta_{BK}$ of various links (boom, arm, bucket) as work elements.

The calculation accuracy of the position of the working point is affected by mechanical backlash. Generally, a clearance is provided between the pin in the swing center of each link and the pin hole and an external force causes eccentricity of the swing center of the link, thereby generating a mechanical backlash. For example, when a stroke sensor which detects the stroke of the actuator for driving each link is used as a posture sensor, due to the influence of mechanical backlash an error occurs in the calculation to find the link angle from the stroke. Therefore, in order to calculate the position of the working point accurately, the direction of eccentricity must be detected or calculated from the direction of the load applied to the swing center of the link.

Patent Literature 1 discloses a control system which includes not only a posture sensor but also a load sensor and calculates the position of the working point according to signals from the posture sensor and the load sensor. In the control system described in Patent Literature 1, the calculation accuracy of the position of the working point is improved by correcting the relative angle of each link depending on the clearance of the swing center and the load direction calculated according to a signal from the load sensor.

CITATION LIST

Patent Literature

PATENT LITERATURE 1: U.S. Pat. No. 6,934,616

SUMMARY OF INVENTION

Technical Problem

However, the control system described in Patent Literature 1 has a problem that since the external force applied to each link is calculated on the assumption that the direction of the force of gravity is downward with respect to the body, for example, if the body is tilted, an error occurs in the load direction and thereby the calculation accuracy of the position of the working point declines.

The present invention has been made with the view of the above problem and an object thereof is to provide a construction machine with high calculation accuracy of the position of the working point.

Solution to Problem

In order to achieve the above object, according to a typical aspect of the present invention, a construction machine is characterized by including: a body; work equipment provided on the body, having a plurality of swingable work elements; a plurality of hydraulic actuators for driving the work equipment; a plurality of ground angle sensors for detecting ground angles of the work elements; and an excavation support device including an information processing device for generating information to support excavation work of an operator, in which the information processing device includes: a load information acquiring section for acquiring load information including a load direction in the swing center of at least one of the work elements according to signals from the ground angle sensors; and a working point position calculating section for calculating the position of a working point of the work equipment according to the signals from the ground angle sensors and the load information from the load information acquiring section.

Advantageous Effects of Invention

According to the present invention, a construction machine with high calculation accuracy of the position of the working point can be provided. Other and further objects, features, and advantages will appear more fully from the following description of embodiments.

DESCRIPTION OF EMBODIMENTS

First Embodiment

Figure 1:
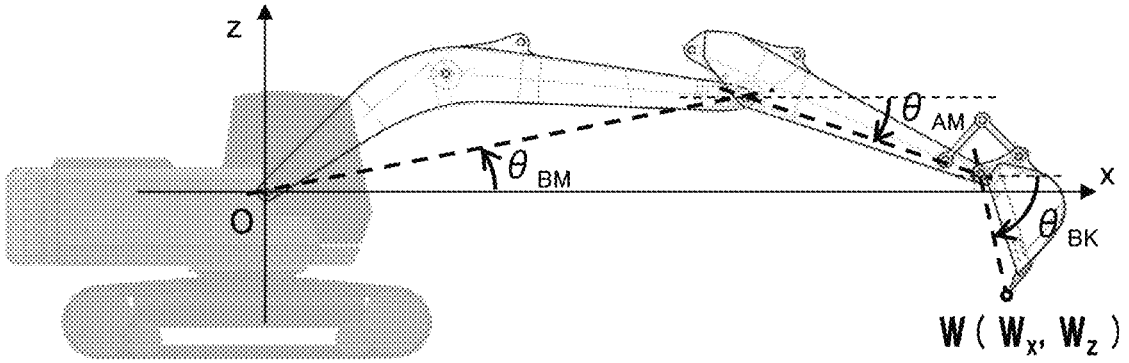
FIG. 1 is a diagram which explains the relation between the angle of each link and the claw position of a bucket.
Figure 2:
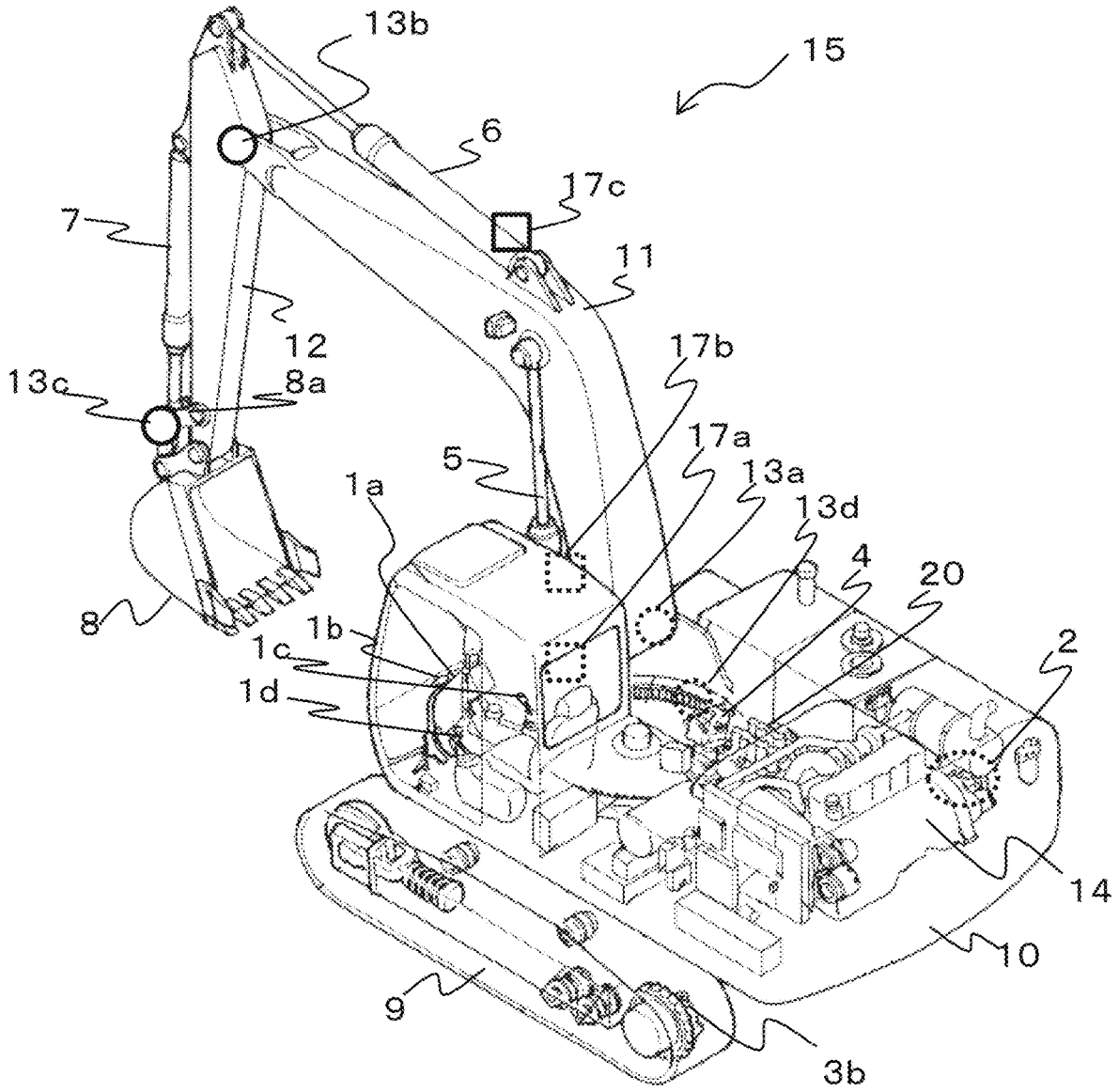
FIG. 2 is a perspective view of a construction machine according to a first embodiment of the present invention.

Next, embodiments of the construction machine according to the present invention will be described referring to drawings. FIG. 2 is a perspective view of the construction machine according to the first embodiment of the present invention. As shown in FIG. 2, the construction machine according to this embodiment includes an undercarriage 9 and an upperstructure 10 which constitute a body, and work equipment 15. The undercarriage 9 has left and right crawler mounted traveling devices and is driven by left and right traveling hydraulic motors 3*b* and 3*a* (only the left motor 3*b* is shown in the figure). The upperstructure 10 is swingably mounted on the undercarriage 9 and swung by a swing hydraulic motor 4. The upperstructure 10 includes an engine 14 as a motor and a hydraulic pump device 2 to be driven by the engine 14.

The work equipment 15 is swingably attached to the front of the upperstructure 10. The upperstructure 10 includes a cab, and in the cab, operation devices such as a traveling right operating lever device 1*a*, traveling left operating lever device 1*b*, and right operating lever device 1*c* and left operating lever device 1*d* for specifying the movement of the work equipment 15 and the swing motion of the upperstructure 10 are arranged.

The work equipment 15 is a multi-joint structure which has a boom 11, arm, 12, and bucket 8 which are swingable work elements, in which the boom 11 swings vertically with respect to the upperstructure 10 by extension/contraction of a boom cylinder 5, the arm 12 swings vertically and forward/backward with respect to the boom 11 by extension/contraction of an arm cylinder 6, and the bucket 8 swings vertically and forward/backward with respect to the arm 12 by extension/contraction of a bucket cylinder 7. Also, the boom cylinder 5 includes a boom bottom pressure sensor 17*a* for detecting the bottom side pressure of the boom cylinder 5 and a boom rod pressure sensor 17*b* for detecting the rod side pressure of the boom cylinder 5. Also, the arm cylinder 6 includes an arm bottom pressure sensor 17*c* for detecting the bottom side pressure of the arm cylinder 6.

In order to calculate the position of an arbitrary point of the work equipment 15, the construction machine includes: a first ground angle sensor 13*a* located near the connection between the upperstructure 10 and the boom 11 to detect the angle of the boom 11 with respect to the horizontal plane (boom angle); a second ground angle sensor 13*b* located near the connection between the boom 11 and the arm 12 to detect the angle of the arm 12 with respect to the horizontal plane (arm angle); a third ground angle sensor 13*c* located at a bucket link 8*a* for connecting the arm 12 and the bucket 8 to detect the angle of the bucket link 8*a* with respect to the horizontal plane (bucket angle); and a body ground angle sensor 13*d* to detect the tilting angle (roll angle, pitch angle) of the upperstructure 10 with respect to the horizontal plane.

The ground angle sensors 13*a* to 13*d* as examples of posture sensors each include at least a two-axis acceleration sensor and can detect the ground angle and the direction of load. The posture sensor signals detected by these ground angle sensors 13*a* to 13*d* and the signals from the above boom bottom pressure sensor 17*a*, boom rod pressure sensor 17*b*, and arm bottom pressure sensor 17*c* as examples of pressure sensors are sent to an information processing device 100 which will be described later. Each of the posture sensor signals sent from the ground angle sensors 13*a* to 13*d* is at least a two-dimensional accelerator vector.

A control valve 20 controls the flow (flow rate and direction) of pressure oil supplied from the hydraulic pump device 2 to each of the hydraulic actuators such as the above swing hydraulic motor 4, boom cylinder 5, arm cylinder 6, bucket cylinder 7, and left and right traveling hydraulic motors 3*b* and 3*a*. This embodiment is described as a structure in which the pressure sensors 17*a* to 17*c* are provided on the boom cylinder 5 and arm cylinder 6, but instead the pressure sensors 17*a* to 17*c* may be provided on the control valve 20 or in the pipe between the control valve 20 and each of the cylinders 5 and 6.

[Excavation Support Device of the Construction Machine]

Figure 3:
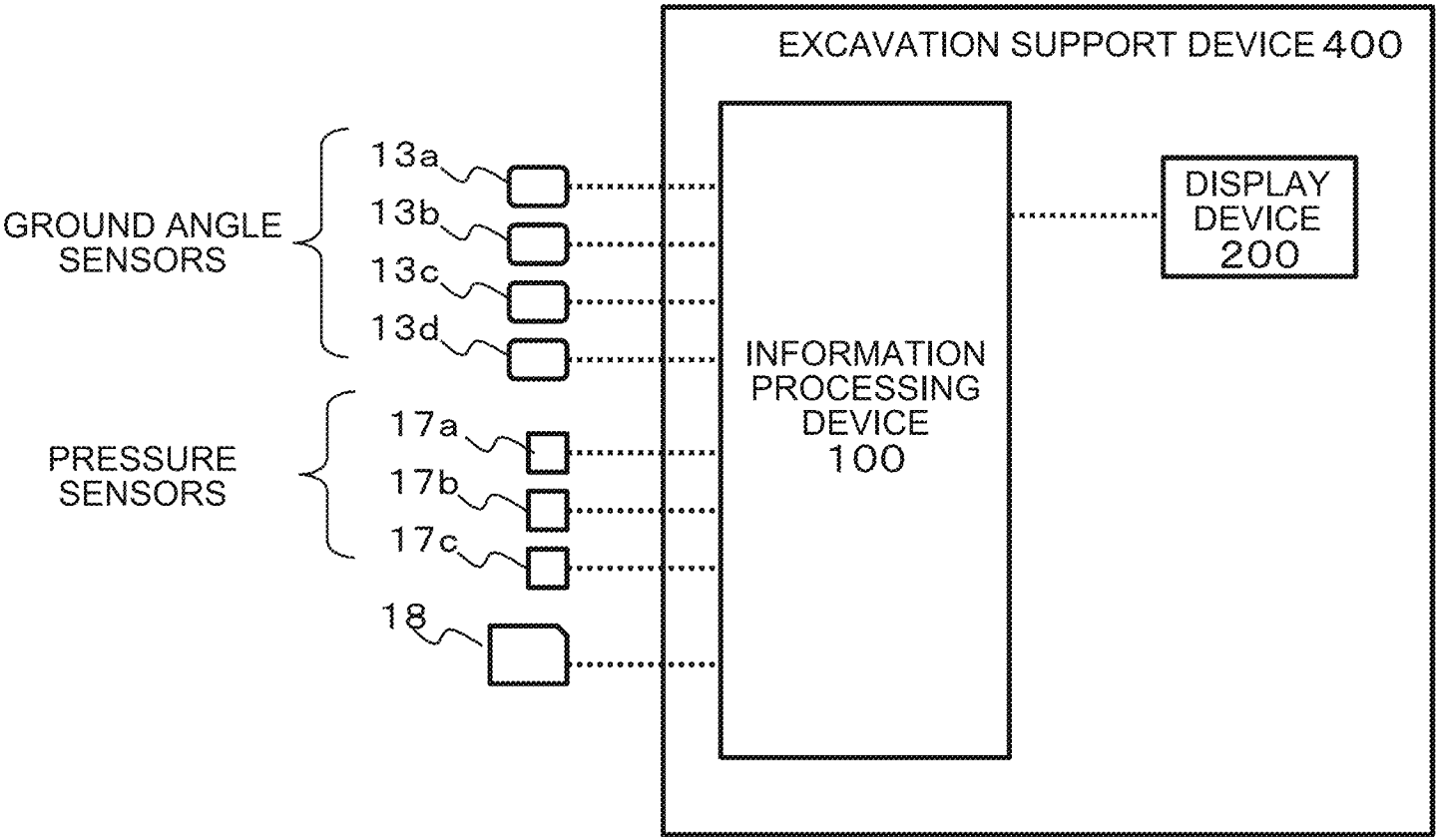
FIG. 3 is a structural diagram which shows an excavation support device mounted on the construction machine shown in FIG. 2.

FIG. 3 is a structural diagram which shows an excavation support device mounted on the construction machine shown in FIG. 2. In FIG. 3, the excavation support device 400 of the construction machine includes an information processing device 100 which generates information to support the excavation work by the operator and a display device 200, for example, a liquid crystal panel, which displays excavation work support information for the operator. The information processing device 100 is structured using hardware including, for example, a CPU (Central Processing Unit) (not shown), a storage device such as a ROM (Read Only Memory) or HDD (Hard Disc Drive) for storing various programs to perform processing by the CPU, and a RAM (Random Access Memory) which functions as a working area in execution of a program by the CPU.

The information processing device 100 receives a first posture sensor signal, second posture sensor signal, third posture sensor signal and body posture sensor signal from the first ground angle sensor 13*a*, second ground angle sensor 13*b*, third ground angle sensor 13*c* and body ground angle sensor 13*d* respectively, receives a boom bottom pressure and boom rod pressure from the boom bottom pressure sensor 17*a* and boom rod pressure sensor 17*b* respectively, receives an arm bottom pressure from the arm bottom pressure sensor 17*c*, receives design surface information from a design data input device 18, and sends the calculation result to the display device 200. Details of the calculations made by the information processing device 100 will be described later, but the calculations made by the display device 200 are the same as in the conventional technique, so detailed description thereof is omitted.

[Information Processing Device]

Figure 4:
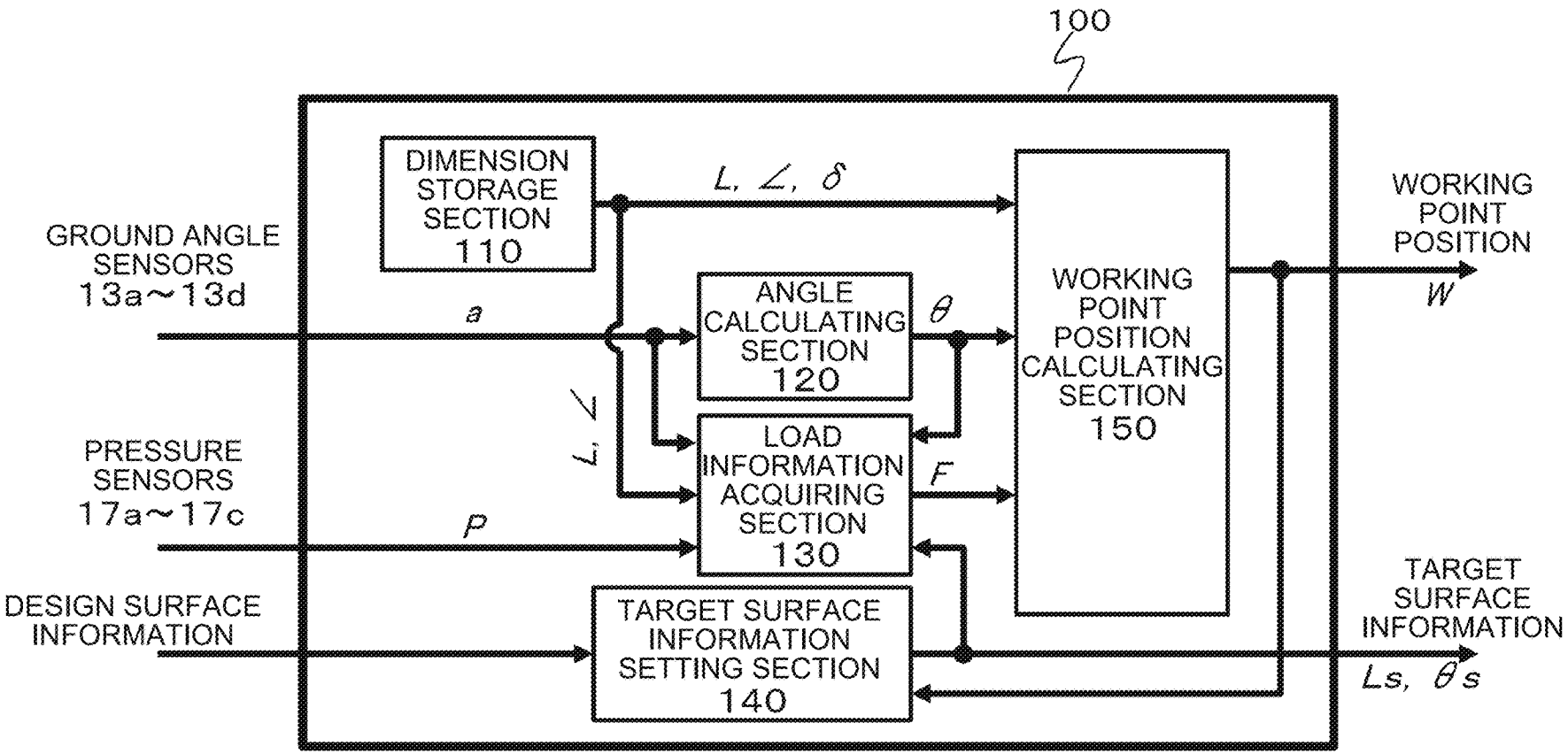
FIG. 4 is a block diagram which shows the detailed structure of the information processing device shown in FIG. 3.

FIG. 4 is a block diagram which shows the detailed structure of the information processing device 100 shown in FIG. 3. As shown in FIG. 4, the information processing device 100 includes a dimension storage section 110, angle calculating section 120, load information acquiring section 130, target surface information setting section 140, and working point position calculating section 150.

The dimension storage section 110 stores dimension information $\llcorner$ and $\angle$ of the work equipment 15 and eccentricity amount information $\delta$ of each swing center of the work equipment 15 in advance and sends information $\llcorner$, $\angle$ and $\delta$ to the load information acquiring section 130 and the working point position calculating section 150.

The angle calculating section 120 receives a posture sensor signal a from each of the ground angle sensors 13*a* to 13*d* and sends the ground angles $\theta$ of the boom 11, arm 12, bucket link 8*a*, and upperstructure 10 to the load information acquiring section 130 and the working point position calculating section 150. In order for the angle calculating section 120 to calculate the ground angle $\theta$, for example, Formula (1) is used:

[Formula 1]

$$\theta_i = -\tan^{-1}\frac{a_{iz}}{a_{ix}} \tag{1}$$

Here, i=1, 2, 3 represent the boom 11, arm 12, and bucket 8 respectively, and $a_{ix}$ and $a_{iz}$ represent the acceleration vector components of each of them. The method for calculating the ground angle θ is not limited to this; instead, the ground angle θ may be calculated by the known sensor fusion method, using a sensor with a gyroscope as a ground angle sensor.

The load information acquiring section 130 receives a posture sensor signal a from each of the ground angle sensors 13*a* to 13*d*, pressure sensor signals P from the pressure sensors 17*a* to 17*c*, dimension information ∟ and ∠ from the dimension storage section 110, ground angles θ of the boom 11, arm 12, and bucket link 8*a* from the angle calculating section 120, and target surface information Ls and θs from the target surface information setting section 140 and sends information F of load applied to the boom 11, arm 12, and bucket 8 to the working point position calculating section 150. Details of the calculations made by the load information acquiring section 130 will be described later.

The target surface information setting section 140 receives design surface information from the design data input device 18 and position information of a working point W from the working point position calculating section 150, extracts the design surface nearest to the working point W among a plurality of design surfaces, as a target surface, and sends the distance Ls and angle θs of the target surface with respect to the reference point of the body (for example, point indicating the boom foot pin height of the swing center) as target surface information to the load information acquiring section 130 and the display device 200.

The working point position calculating section 150 receives the dimension information ∟ and ∠ and eccentricity amount information δ of the work equipment 15 from the dimension storage section 110, the ground angles θ of the boom 11, arm 12, bucket link 8*a*, and upperstructure 10 from the angle calculating section 120, and the information F of load applied to the boom 11, arm 12, and bucket 13 from the load information acquiring section 130, calculates the position of the working point W, and sends it to the display device 200 and the target surface information setting section 140. Details of the calculations made by the working point position calculating section 150 will be described later.

[Load Information Acquiring Section]

Figure 5:
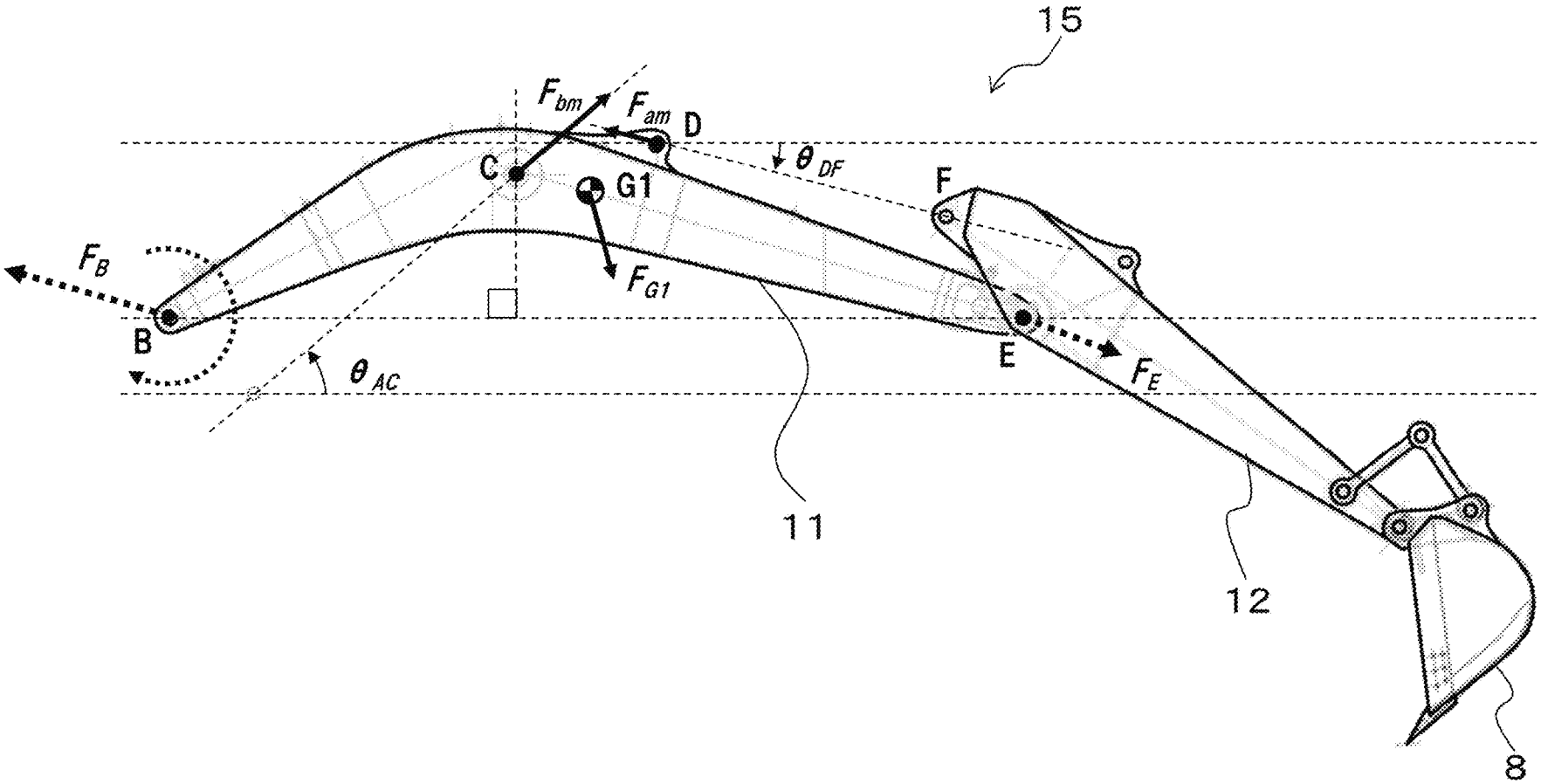
FIG. 5 is a view which explains the calculation of the external force applied to the boom.
Figure 6:
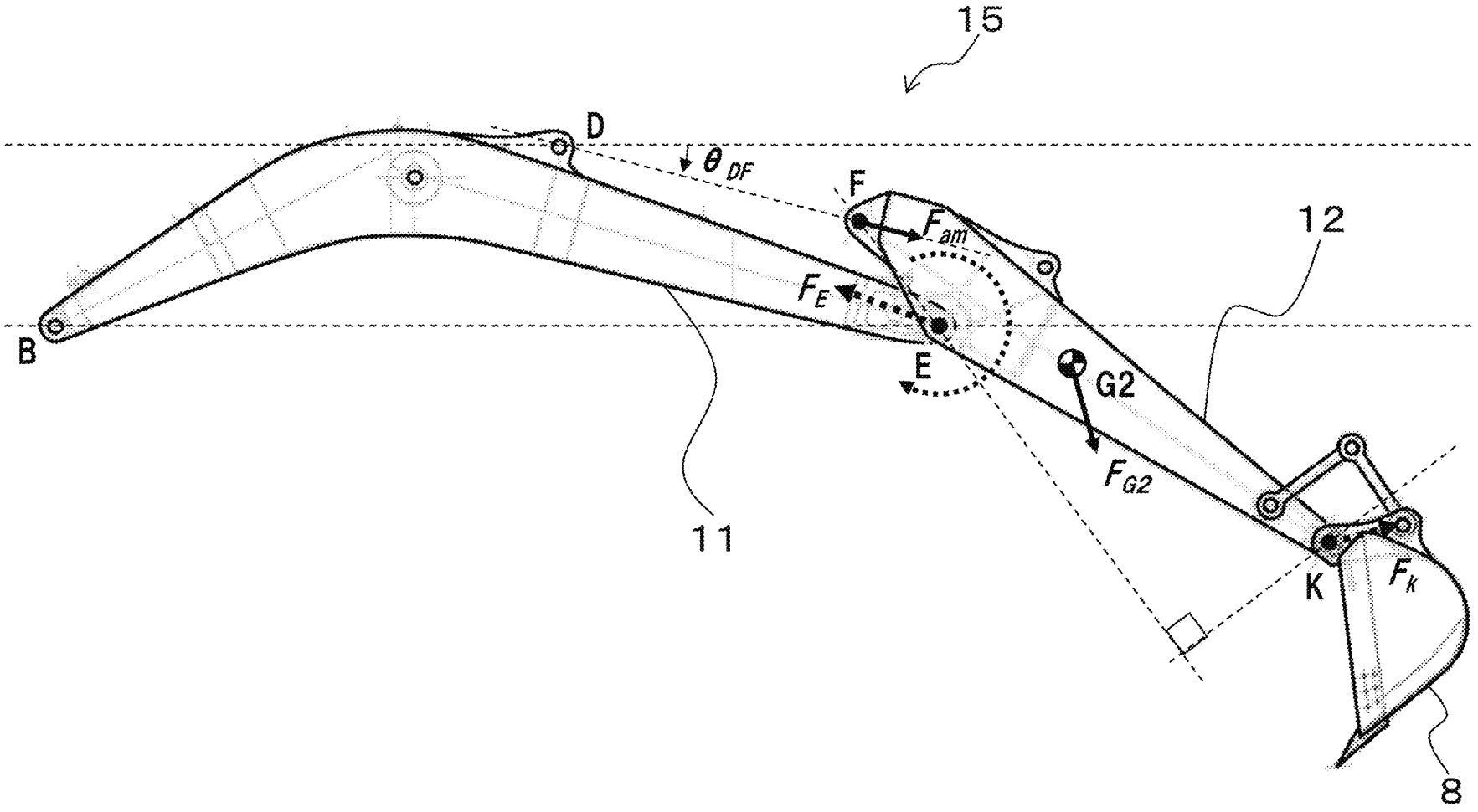
FIG. 6 is a view which explains the calculation of the external force applied to the arm.

The calculations made by the load information acquiring section 130 are described below referring to FIGS. 5 to 7A,B. FIG. 5 is a view which explains the calculation of the external force applied to the boom 11, FIG. 6 is a view which explains the calculation of the external force applied to the arm 12, and FIGS. 7A,B are views which explain the calculation of the rotation direction of the bucket 8. The arrows shown in FIG. 5 represent the external forces applied to the boom 11. G1 represents the position of the center of gravity of the boom 11 and the force of gravity $F_{G1}$ is applied to G1. The force of gravity $F_{G1}$ is calculated by multiplying the acceleration vector $a_{G1}$ as the posture sensor signal a by the mass of the boom 11. $F_{bm}$ and $F_{am}$ represent the thrust forces of the boom cylinder 5 and arm cylinder 6 respectively and are calculated by multiplying each pressure sensor signal P by the effective area of each of the cylinders 5 and 6.

In this embodiment, calculations are made only for excavation by arm crowding on the assumption that the rod pressure of the arm cylinder 6 is 0. However, if calculations are also made for arm dumping, it is desirable to acquire the rod pressure of the arm cylinder 6. $F_B$ and $F_E$ are the external forces applied to the swing center B of the boom 11 and the swing center E of the arm 12 respectively. When a point B is assumed as an origin and the direction from the point B to a point E is assumed as an x axis, the equilibrium of these forces is expressed by Formula (2).

[Formula 2]

$$F_B^{BE}+F_{bm}^{BE}+F_{am}^{BE}+F_{G1}^{BE}+F_E^{BE}=0 \tag{2}$$

Here, the superscript suffix of each external force represents the x axis of the coordinate system.

The equilibrium of moments around the point B is expressed by Formula (3).

[Formula 3]

$$-F_{bmz}^{BE}L_{BC}\cos\angle CBE+F_{bmx}^{BE}L_{BC}\sin\angle CBE-F_{amz}^{BE}L_{BD}\cos\angle DBE+F_{amx}^{BE}L_{BD}\sin\angle DBE-F_{G1z}^{BE}L_{BG1}\cos\angle G1BE+F_{G1x}^{BE}L_{BG1}\sin\angle G1BE-F_{Ez}^{BE}L_{BE}=0 \tag{3}$$

$F_B$ and $F_E$ are unknown and the calculations cannot be made only by Formulas (2) and (3). Therefore, the external force applied to the arm 12 is also added for the calculations. The arrows shown in FIG. 6 represent the external forces applied to the arm 12. G2 represents the position of the center of gravity of the arm 12 and the force of gravity $F_{G2}$ is applied to G2. The force of gravity $F_{G2}$ is calculated by multiplying the acceleration vector $a_{G2}$ as the posture sensor signal a by the mass of the arm 12. $F_E$ and $F_K$ are the external forces applied to the swing center E of the arm 12 and the swing center K of the bucket 8 respectively. When a point E is assumed as an origin and the direction from a point F to the point E is assumed as an x axis, the equilibrium of these forces is expressed by Formula (4).

[Formula 4]

$$F_E^{BE}+F_{am}^{BE}+F_{G2}^{FE}+F_K^{FE}=0 \tag{4}$$

In addition, the equilibrium of moments around the point E is expressed by the following formula.

[Formula 5]

$$F_{amz}^{FE}L_{FE}-F_{G2z}^{FE}L_{EG2}\cos(\pi-\angle FEG2)+F_{G2x}^{FE}L_{EG2}\sin(\pi-\angle FEG2)-F_{Kz}^{FE}L_{ER}\cos(\pi-\angle FEK)+F_{Kx}^{FE}L_{EK}\sin(\pi-\angle FEK)=0 \tag{5}$$

Here, $F_E$ is an external force applied to both the boom 11 and the arm 12, which is applied to them in opposite directions.

The coordinate transformation of FE between the coordinate system with the point B as the origin and the coordinate system with the point E as the origin is expressed by Formula (6).

[Formula 6]

$$\begin{bmatrix} F_{Ex}^{BE} \\ F_{Ez}^{BE} \end{bmatrix} = \begin{bmatrix} \cos(\theta_{am}+\pi-\angle FEK) & \sin(\theta_{am}+\pi-\angle FEK) \\ -\sin(\theta_{am}+\pi-\angle FEK) & \cos(\theta_{am}+\pi-\angle FEK) \end{bmatrix} \begin{bmatrix} F_{Ex}^{BE} \\ F_{Ez}^{BE} \end{bmatrix} \tag{6}$$

The z components of Formulas (4), (5), and (6) are combined and compiled into Formula (7).

[Formula 7]

$$\begin{bmatrix} 1 & 0 & 1 & 0 \\ 0 & 1 & 0 & 1 \\ \sin(\theta_{am} - \angle FEK) & -\cos(\theta_{am} - \angle FEK) & 0 & 0 \\ 0 & 0 & -L_{EK}\sin\angle FEK & -L_{EK}\cos\angle FEK \end{bmatrix} \begin{bmatrix} F_{Ex}^{FE} \\ F_{Ez}^{FE} \\ F_{Kx}^{FE} \\ F_{Kz}^{FE} \end{bmatrix} = \begin{bmatrix} -F_{amx}^{FE} - F_{G2x}^{FE} \\ -F_{amz}^{FE} - F_{G2z}^{FE} \\ F_{Kx}^{BE} \\ M_{amG} \end{bmatrix} \quad (7)$$

Here, $F^{BE}_{Ez}$ on the right side is a transformation of Formula (3) and $M_{amG}$ is the first to third terms of the left side of Formula (5), so they can be calculated using Formulas (8) and (9), respectively.

[Formula 8]

$$F_{Kz}^{BE}=(-F_{bmc}^{BE}L_{BC}\cos\angle CBE+F_{bmx}^{BE}L_{BC}\sin\angle CBE-F_{amz}^{BE}L_{BD}\cos\angle DBE+F_{amx}^{BE}L_{BD}\sin\angle DBE-F_{G1z}^{BE}L_{BG1}\cos\angle G1BE+F_{G1x}^{BE}L_{BG1}\sin\angle G1BE)/L_{BE}=0 \quad (8)$$

[Formula 9]

$$M_{amG}=F_{amz}^{FE}L_{FE}-F_{G2z}^{FE}L_{EG2}\cos(\pi-\angle FEG2)+F_{G2x}^{FE}L_{EG2}\sin(\pi-\angle FEG2) \quad (9)$$

As mentioned above, the external forces applied to the swing centers of the boom 11, arm 12, and bucket 8 are known by calculating $F_B$ using Formula (2) after calculating the external forces $F_E$ and $F_K$ from Formula (7). In this embodiment, since the forces of gravity $F_{G1}$ and $F_{G2}$ are calculated on the basis of the acceleration vector as the posture sensor signal a, the external forces applied to the swing centers of the boom 11, arm 12, and bucket 8 can be calculated accurately even when the body (namely, the undercarriage 9 and the upperstructure 10) is tilted.

In this embodiment, in order to simplify the explanation, the external force applied to the bucket 8 is not added in the calculations; however, by installing a pressure sensor on the bucket cylinder 7 and taking the thrust force of the bucket cylinder 7 into consideration, the external force applied to the bucket 8 may be added in the calculations.

Figure 7A:
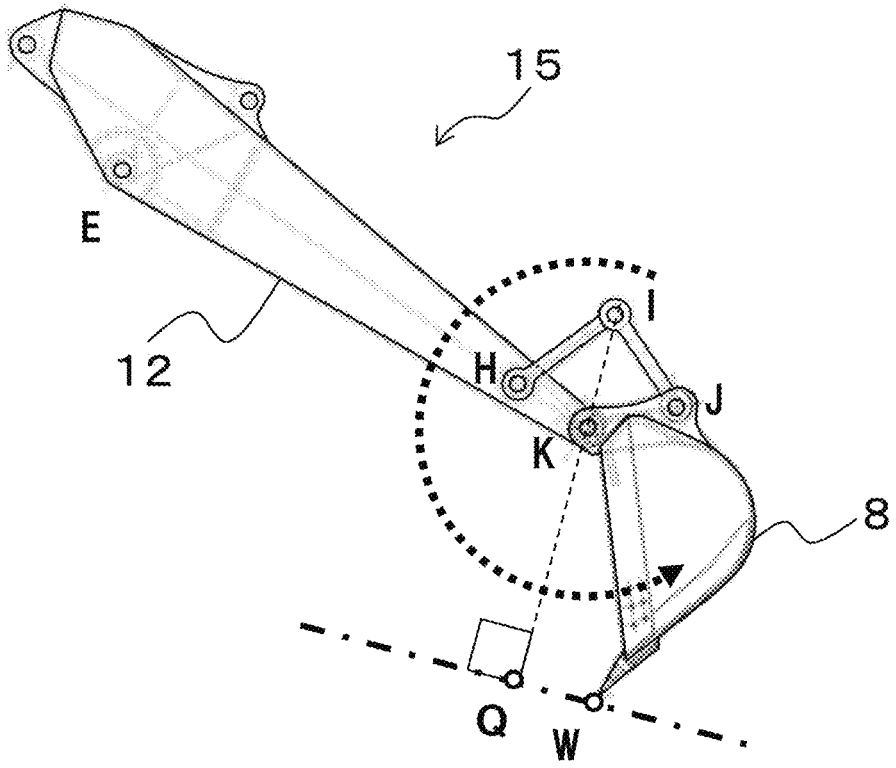
FIGS. 7A,B are views which explain the calculation of the rotation direction of the bucket.
Figure 7B:
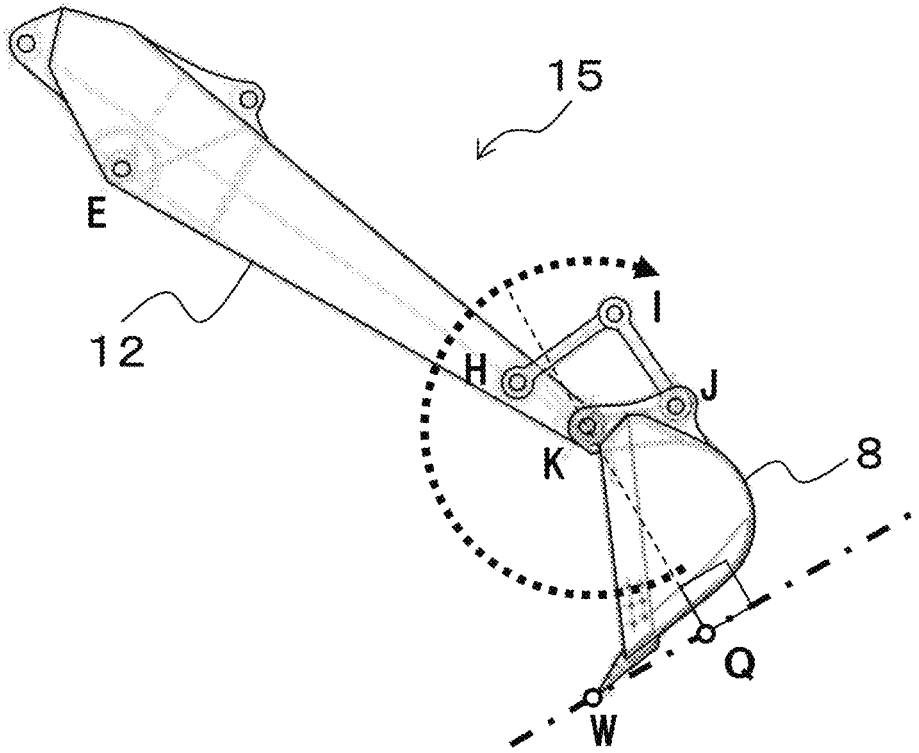

Next, the calculation of the rotation direction of the bucket 8 which is made by the load information acquiring section 130 will be explained referring to FIGS. 7A,B. The dashed-dotted line in FIGS. 7A,B indicates the target surface and the dotted line arrow indicates the rotation direction of the bucket 8 which unintentionally occurs due to mechanical backlash. As shown in FIG. 7A, if the working point W is remoter from the arm swing center E than the point of intersection Q where the perpendicular line from the swing center K of the bucket 8 to the target surface intersects the target surface, it is decided that the bucket 8 is rotating in the dumping direction. As shown in FIG. 7B, if the working point W is nearer to the arm swing center E than the point of intersection Q where the perpendicular line from the swing center K of the bucket 8 to the target surface intersects the target surface, it is decided that the bucket 8 is rotating in the crowding direction.

As mentioned above, even when a pressure sensor is not provided on the bucket cylinder 7, the rotation direction of the bucket 8 can be calculated according to the angle of the target surface in a simple manner.

[Working Point Position Calculating Section]

The working point position calculating section 150 calculates the position of the working point W according to the ground angles θ of the boom 11, arm 12, bucket link 8*a*, and upperstructure 10 from the angle calculating section 120. Here, in this embodiment, the ground angles θ of the boom 11, arm 12 and upperstructure 10 are directly detected using the ground angle sensors 13*a*, 13*b*, and 13*d* and thus these angles are not affected by mechanical backlash. Meanwhile, the angle of the bucket 13 is calculated according to the ground angle θ of the bucket link 8*a* and thus it is affected by mechanical backlash. Therefore, the ground angle $\theta_{bk}$ of the bucket 8 is calculated from the ground angle $\theta_{bk1}$ of the bucket link 8*a* from the angle calculating section 120 and the rotation direction of the bucket 8 attributable to mechanical backlash from the load information acquiring section 130, using Formula (10).

[Formula 10]

$$\begin{aligned} \theta_{bk} &= \pi - (\alpha_{JKL} + \alpha_1 + \alpha_2 + \alpha_{EKH}) \\ \alpha_1 &= \cos^{-1}\left(\frac{L_{JK}^2 + L_{IK}^2 - (L_{IJ} + \delta_I + \delta_J)^2}{2L_{JK}L_{IK}}\right) \\ \alpha_2 &= \cos^{-1}\left(\frac{L_{HK}^2 + L_{IK}^2 - L_{HI}^2}{2L_{HK}L_{IK}}\right) \\ L_{IK}^2 &= L_{HI}^2 + L_{HK}^2 - 2L_{HI}L_{HK}\cos\theta_{bkl} \end{aligned} \quad (10)$$

Here, $\delta_I$ and $\delta_J$ represent the eccentricity amounts of swing centers I and J (see FIGS. 7A,B) of the bucket link 8*a* respectively and if the rotation direction of the bucket 8 attributable to mechanical backlash is the crowding direction, a positive value is entered for the calculations, and if it is the dumping direction, a negative value is entered. Consequently, an error in conversion into the ground angle $\theta_{bk}$ of the bucket 8 which is attributable to mechanical backlash is corrected.

Next, the position of the working point W is calculated from the ground angles $\theta_{bn}$ and $\theta_{am}$ of the boom 11 and arm 12 from the angle calculating section 120, the external forces $F_B$, $F_E$, and $F_K$ applied to the swing centers of the boom 11, arm 12, and bucket 8 as load information from the load information acquiring section 130, and the rotation direction of the bucket 8 attributable to mechanical backlash, using Formula (11).

[Formula 11]

$$W_x^{Body} = L_{bm}\cos(\theta_{bnm} - \theta_{Body}) + L_{am}\cos(\theta_{am} - \theta_{Body}) + L_{bk}\cos(\theta_{bk} - \theta_{Body}) - \delta_B\cos_B - \delta_E\cos\theta_E - \delta_K\cos\theta_K \quad (11)$$

$$W_z^{Body} = -L_{bm}\sin(\theta_{bnm} - \theta_{Body}) - L_{am}\sin(\theta_{am} - \theta_{Body}) - L_{bk}\sin(\theta_{bk} - \theta_{Body}) - \delta_B\sin_B - \delta_E\sin\theta_E - \delta_K\sin\theta_K$$

$$\theta_B = \tan^{-1}\frac{F_{Ez}^{Body}}{F_{Ez}^{Body}},\ \theta_E = \tan^{-1}\frac{F_{Ez}^{Body}}{F_{Ez}^{Body}},\ \theta_K = \tan^{-1}\frac{F_{Kz}^{Body}}{F_{Kz}^{Body}}$$

Here, the superscript suffix Body represents the coordinate system based on the upperstructure 10. $\delta_B$, $\delta_E$, and $\delta_K$ represent the eccentricity amounts of the swing centers B, E, and K of the boom 1, arm 12, and bucket 8 respectively, which are received from the dimension storage section 110.

Also, $\theta_B$, $\theta_E$, and $\theta_K$ represent the directions of the external forces applied to the swing centers B, E, and K of the boom 1, arm 12, and bucket 8 with respect to the upperstructure 10. By adding an eccentricity amount in the opposite directions to them, the amount of movement in the translation direction attributable to the mechanical backlash is corrected so that the calculation accuracy of the position of the working point W can be improved.

As explained above, according to the first embodiment, the direction and magnitude of the force of gravity are detected using the ground angle sensors 13*a* to 13*d* including at least a two-axis acceleration sensor and the external forces applied to the swing centers B, E, and K of the work equipment 15 are calculated according to the force of gravity, so even when the body is tilted, the calculation accuracy of the position of the working point W attributable to mechanical backlash can be improved. In addition, the pressures of two or more hydraulic actuators (specifically, the boom cylinder 5 and arm cylinder 6) which drive the work equipment 15 are detected to calculate the magnitude and direction of the excavation reactive force and calculate the external forces applied to the swing centers B, E, and K of the work equipment 15 by the excavation reactive force, so that the calculation accuracy of the position of the working point W which is attributable to mechanical backlash can be improved.

Second Embodiment

Figure 8:
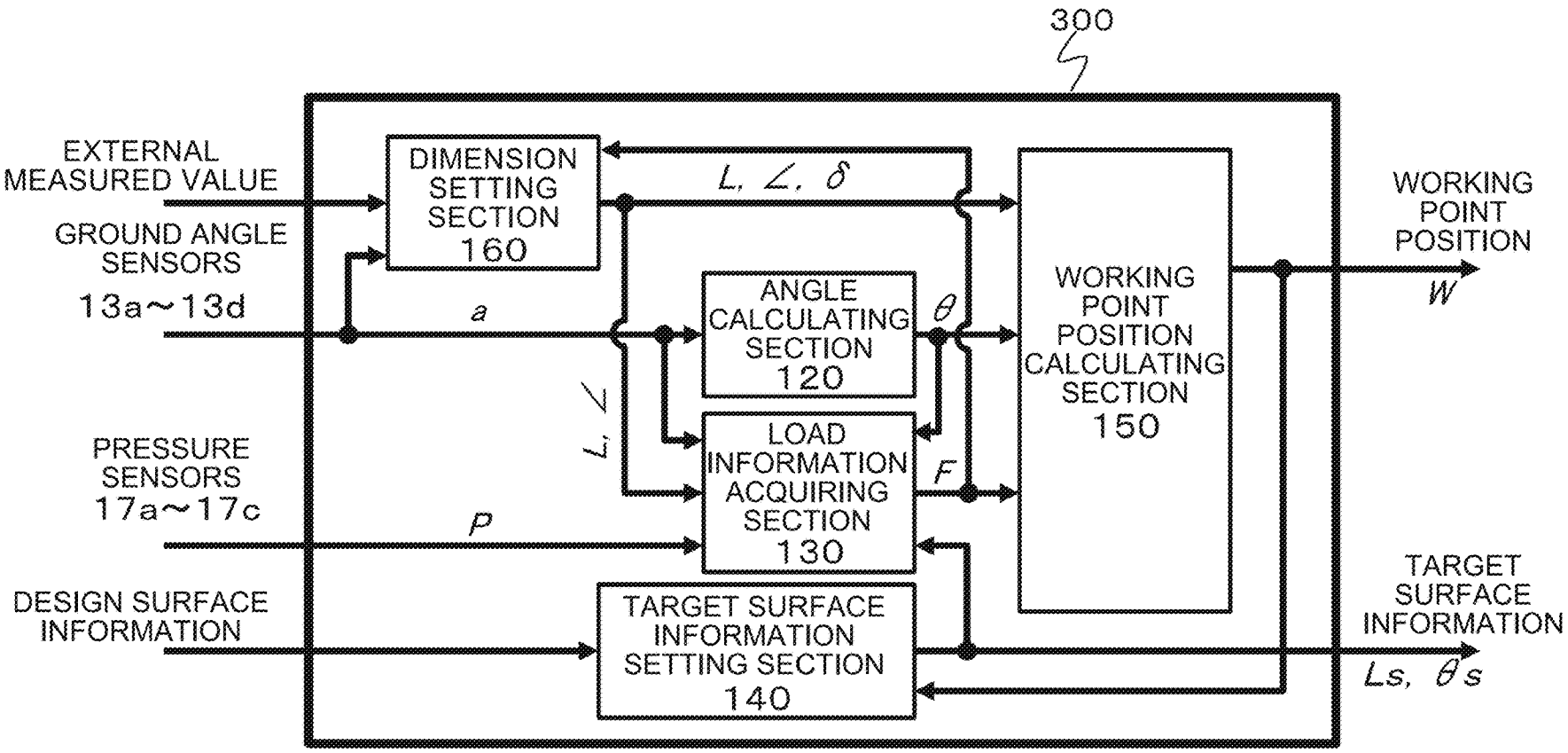
FIG. 8 is a block diagram which shows the detailed structure of the information processing device of an excavation support device mounted on a construction machine according to a second embodiment of the present invention.

Next, a construction machine according to the second embodiment of the present invention will be described referring to drawings. The same elements as in the first embodiment are designated by the same reference signs and description thereof is omitted. FIG. 8 is a block diagram which shows the detailed structure of the information processing device of an excavation support device mounted on the construction machine according to the second embodiment of the present invention. As shown in FIG. 8, in the information processing device 300 in the second embodiment, the dimension storage section 110 in the first embodiment is replaced by a dimension setting section 160. The dimension setting section 160 receives external measured values, a posture sensor signal a from each of the ground angle sensors 13*a* to 13*d*, and load information F from the load information acquiring section 130 and calculates the dimension information ∟ and ∠ of the work equipment 15 and the eccentricity amount information δ of each swing center of the work equipment 15 and sends the calculation result to the load information acquiring section 130 and the working point position calculating section 150.

Here, the external measured values are the coordinates of the swing centers of the boom 11, arm 12, and bucket 8 which are measured using a total station or the like. Only when these are received, the dimension setting section 160 calculates the dimension information ∟ and ∠ of the work equipment 15 and the eccentricity amount information δ of each swing center and when these are not received, the dimension setting section 160 continues to send the previously calculated values.

Figure 9:
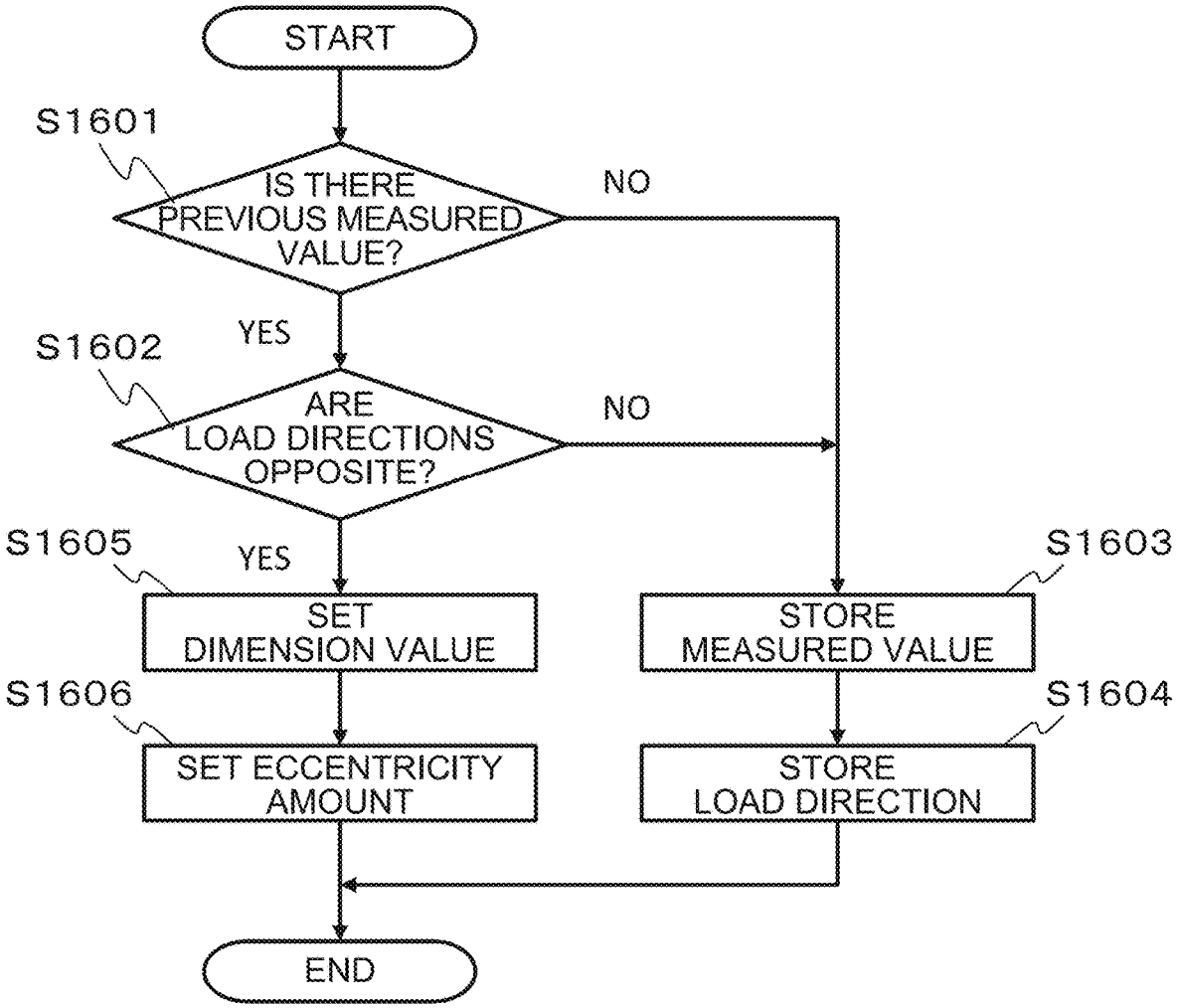
FIG. 9 is a flowchart which shows the arithmetic processing sequence which is performed by the dimension setting section shown in FIG. 8.

The calculations made by the dimension setting section 160 are described below referring to FIG. 9. FIG. 9 is a flowchart which shows the arithmetic processing sequence which is performed by the dimension setting section 160 shown in FIG. 8. The processing shown in FIG. 9 is performed for each link of the work equipment 15. Here, the sequence is explained, taking the boom 11 for example. In this case, the external measured values are the coordinates ($E_X$, $E_Z$) of the swing center of the boom 11 and the coordinates ($B_X$, $B_Z$) of the swing center of the arm 12.

The dimension setting section 160 decides whether or not there is any previous external measured value (S1601) and if there is a previous external measured value (S1601/YES), comparison is made between the load direction of the swing center of the boom 11 at the time of input of the previous external measured value and that at the time of input of the current external measured value (S1602). If the load directions are opposite (S1602/YES), the dimension setting section 160 sets a dimension value $L_{BE}$ of the boom 11 which will be described later (S1605) and sets an eccentricity amount $\delta_B$ of the swing center of the boom 11 which will also be described later (S1606).

Meanwhile, if there is no previous external measured value (S1601/NO) or the load directions are not opposite (S1602/NO), the dimension setting section 160 stores the current external measured value (S1603) and stores the load direction of the swing center of the boom 11 at the time of input of the current external measured value (S1604).

At Step S1605, the dimension value $L_{BE}$ of the boom 11 is calculated from the current external measured value and the previous external measured value, using Formula (12).

[Formula 12]

$$L_{BE} = \frac{1}{2}\sum_{i=1}^{2}\sqrt{(E_x^i - B_x^i)^2 + (E_z^i - B_z^i)^2} \quad (12)$$

where the superscript suffixes of the respective swing centers E and B of the boom 11 and arm 12 represent times of input of external measured values, in which i=1 represents the previous value and i=2 represents the current external measured value.

At Step S1606, the eccentricity amount $\delta_B$ of the swing center of the boom 11 is calculated from the current external measured value and the previous external measured value, using Formula (13).

[Formula 13]

$$\delta_B = \frac{\sqrt{(E_x^1 - B_x^1)^2 + (E_z^1 - B_z^1)^2} - \sqrt{(E_x^2 - B_x^2)^2 + (E_z^2 - B_z^2)^2}}{2} \quad (13)$$

The calculations made by the dimension setting section 160 are not limited to the above; the load direction may be divided into n directions to calculate the dimension and eccentricity amount from n external measured values and in that case, Formulas (14) and (15) are used, respectively.

[Formula 14]

$$L_{BE} = \frac{1}{n}\sum_{i=1}^{n}\sqrt{(E_x^i - B_x^i)^2 + (E_z^i - B_z^i)^2} \tag{14}$$

[Formula 15]

$$\delta_B = 2\sqrt{\frac{1}{n}\sum_{i=1}^{n}\left(\sqrt{(E_x^i - B_x^i)^2 + (E_z^i - B_z^i)^2} - L_{BE}\right)} \tag{15}$$

Specifically, the dimension is calculated from the average of the n external measured values and the eccentricity amount is calculated from the dispersion. In Formula (12), twice as much as the standard deviation is taken as the eccentricity amount; however, instead, one time or three times as much as the standard deviation may be taken.

As explained above, according to the second embodiment, the same advantageous effects as in the first embodiment are brought about and also by resetting the dimension and eccentricity amount using external measured values, the calculation accuracy of the position of the working point W can be maintained even if the eccentricity amount changes because of wear or the like. Furthermore, by making calculations using external measured values in the case that the load directions are different, deviation of external measured values can be avoided and the dimension and eccentricity amount can be set accurately.

Figure 10:
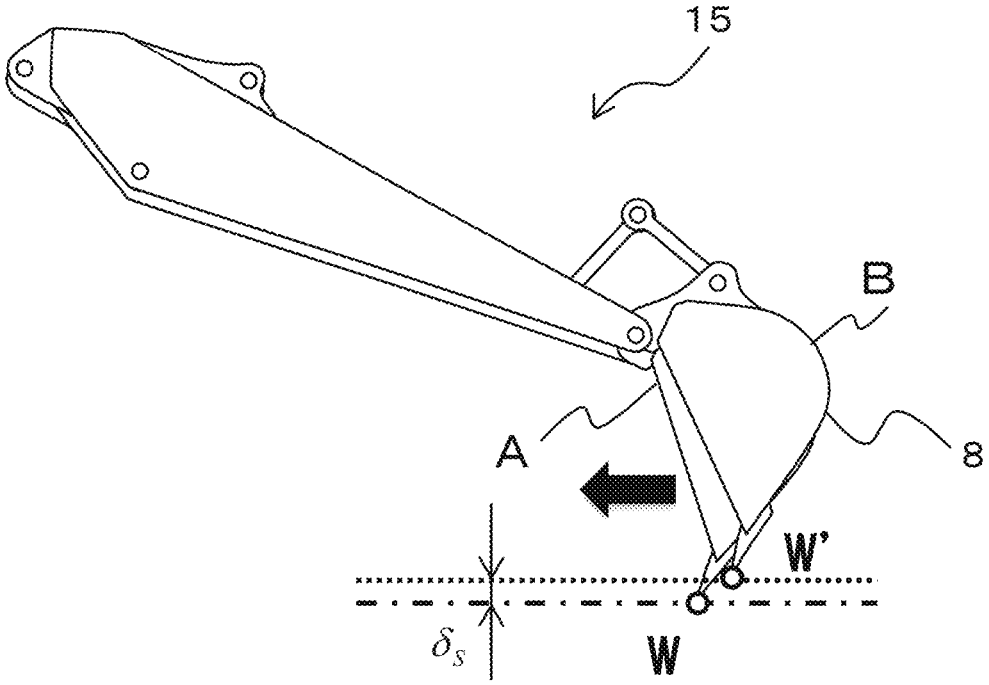
FIG. 10 is a view which explains the difference in the calculation accuracy of the working point between the present invention and the conventional technique.

When the posture sensor signals a from the ground angle sensors 13*a* to 13*d* are the same, the difference between the case of calculating the position of the working point W according to the present invention and the case of calculating the position of the working point W using the conventional technique (only the ground angle sensor) is explained below referring to FIG. 10. FIG. 10 is a view which explains the difference in the calculation accuracy of the working point W between the present invention and the conventional technique. In the figure, the dashed-dotted line represents the target surface and the arrow represents the traveling direction of the work equipment 15. As a result of calculation by the conventional technique, even when the claw (working point W) of the bucket 8 contacts the target surface as indicated by A in the figure, at the time of excavation an excavation reactive force is generated in the direction opposite to the traveling direction of the work equipment 15 and away from the target surface and thus actually the claw (working point W') of the bucket 8 may not reach the target surface due to the influence of mechanical backlash as indicated by B in the figure.

At this time, error $\delta_S$ in the height direction between the working point W and the working point W' is expressed by Formula (16).

[Formula 16]

$$\delta_S = -\delta_B \sin\theta_B - \delta_K \sin\theta_E - \delta_K \sin\theta_K - L_{bk}\{\sin(\theta_{0bk} - \theta_{Body}) - \sin(\theta_{bk} - \theta_{Body})\} \tag{16}$$

where $\theta_{0bk}$ represents the ground angle of the bucket in the case that the calculation is made with $\delta_I$ and $\delta_J = 0$ in Formula (10)

As explained so far, when the present invention is applied, the position of the working point W can be calculated in consideration of the mechanical backlash depending on the load direction, so the influence of the excavation reactive force can be suppressed and the error $\delta_S$ can be eliminated. Therefore, the calculation accuracy of the position of the working point W is improved, largely contributing to support of the operator's work. In addition, since work support information based on the accurately calculated working point W can be displayed on the display device 200, the operator's working efficiency can be improved.

The present invention is not limited to the above embodiments but includes various variations. For example, the above embodiments have been described in detail for easy understanding of the present invention and the present invention is not limited to an embodiment which includes all the described elements.

REFERENCE SIGNS LIST

5 . . . Boom cylinder (hydraulic actuator)
6 . . . Arm cylinder (hydraulic actuator)
7 . . . Bucket cylinder (hydraulic actuator)
8 . . . Bucket (work element)
9 . . . Undercarriage (body)
10 . . . Upperstructure (body)
11 . . . Boom (work element)
12 . . . Arm (work element)
13*a* . . . First ground angle sensor (ground angle sensor)
13*b* . . . Second ground angle sensor (ground angle sensor)
13*c* . . . Third ground angle sensor (ground angle sensor)
13*d* . . . Body ground angle sensor (ground angle sensor)
17*a* . . . Boom bottom pressure sensor (pressure sensor)
17*b* . . . Boom rod pressure sensor (pressure sensor)
17*c* . . . Arm bottom pressure sensor (pressure sensor)
15 . . . Work equipment
100 . . . Information processing device
110 . . . Dimension storage device
120 . . . Angle calculating section
130 . . . Load information acquiring section
140 . . . Target surface information setting section
150 . . . Working point position calculating section
160 . . . Dimension setting section
200 . . . Display device
300 . . . Information processing device
400 . . . Excavation support device

The invention claimed is:

1. A construction machine, comprising:

a body; work equipment provided on the body, having a plurality of swingable work elements; a plurality of hydraulic actuators for driving the work equipment; a plurality of ground angle sensors for detecting ground angles of the work elements; and an excavation support device including an information processing device for generating information to support excavation work of an operator and a display device for displaying the information for the operator, wherein the information processing device includes:

a load information acquiring section for acquiring load information including a load direction in a swing center of at least one of the work elements according to signals received from the ground angle sensors;

an angle calculating section for calculating the ground angle of each of the work elements according to the signals received from the ground angle sensors;

a dimension storage section for storing dimension information of each of the work elements;

a working point position calculating section for calculating a position of a working point of the work equipment according to the signals received from the ground angle sensors, the load information acquired by the load information acquiring section according to the signals received from the ground angle sensors, the ground angle calculated by the angle calculating section, and the dimension information stored in the dimension storage section; and a target surface information setting section for setting, according to information on a design surface entered from outside and the position of the working point of the work equipment calculated by the working point position calculating section, target surface information including an angle of the design surface with respect to the body, wherein the information processing device displays the position of the working point of the work equipment calculated by the working point position calculating section and information based on the target surface information set by the target surface information setting section on the display device.

2. The construction machine according to claim 1, further comprising:

a plurality of pressure sensors for detecting pressures of the hydraulic actuators, wherein the load information acquiring section acquires the load information according to the signals received from the ground angle sensors, but also the dimension information stored in the dimension storage section, the signals received from the pressure sensors, the ground angle calculated by the angle calculating section, and the target surface information set by the target surface information setting section.

3. The construction machine according to claim 2, wherein the dimension storage section stores a dimension and a swing center eccentricity amount of each of the work elements, as the dimension information, and the target surface information setting section sets a distance and an angle of the design surface with respect to a reference point of the body, as the target surface information.

4. A construction machine comprising:

a body; work equipment provided on the body, having a plurality of swingable work elements; a plurality of hydraulic actuators for driving the work equipment; a plurality of ground angle sensors for detecting ground angles of the work elements; and an excavation support device including an information processing device for generating information to support excavation work of an operator and a display device for displaying the information for the operator, wherein the information processing device includes:

a load information acquiring section for acquiring load information including a load direction in a swing center of at least one of the work elements according to signals received from the ground angle sensors;

an angle calculating section for calculating the ground angle of each of the work elements according to the signals received from the ground angle sensors;

a dimension setting section for setting dimension information of each of the work elements by calculation according to a measured value entered from outside, the signals received from the ground angle sensors, and the load information acquired by the load information acquiring section;

a working point position calculating section for calculating a position of a working point of the work equipment according to the signals received from the ground angle sensors, the load information acquired by the load information acquiring section according to the signals received from the ground angle sensors, the ground angle calculated by the angle calculating section, and the dimension information set by the dimension setting section; and a target surface information setting section for setting, according to information on a design surface entered from outside and the position of the working point of the work equipment calculated by the working point position calculating section, target surface information including an angle of the design surface with respect to the body, wherein the information processing device displays the position of the working point of the work equipment calculated by the working point position calculating section and information based on the target surface information set by the target surface information setting section on the display device.

5. The construction machine according to claim 4, further comprising:

a plurality of pressure sensors for detecting pressures of the hydraulic actuators, wherein the load information acquiring section acquires the load information according to the signals received from the ground angle sensors, but also the dimension information set by the dimension setting section, the signals received from the pressure sensors, the ground angle calculated by the angle calculating section, and the target surface information set by the target surface information setting section.

6. The construction machine according to claim 5, wherein the dimension setting section calculates a dimension and a swing center eccentricity amount of each of the work elements, as the dimension information, and the target surface information setting section sets a distance and an angle of the design surface with respect to a reference point of the body, as the target surface information.

* * * * *